US006924258B2

(12) United States Patent
Delamarche et al.

(10) Patent No.: US 6,924,258 B2
(45) **Date of Patent: *Aug. 2, 2005**

(54) WATER-SOLUBLE POUCHES

(75) Inventors: Gwenael Delamarche, Auderghem (BE); David Ingram, Brussels (BE); Gisbert Spieles, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 175 days.

This patent is subject to a terminal disclaimer.

(21) Appl. No.: 10/302,298

(22) Filed: Nov. 22, 2002

(65) Prior Publication Data

US 2003/0100463 A1 May 29, 2003

(30) Foreign Application Priority Data

Nov. 23, 2001 (EP) ..... 01870257

(51) Int. Cl.[7] ..... C11D 17/04
(52) U.S. Cl. ..... 510/296; 510/406; 510/439
(58) Field of Search ..... 510/296, 406, 510/439; 428/35.4, 36.4

(56) References Cited

U.S. PATENT DOCUMENTS

| | | | | |
|---|---|---|---|---|
| 4,416,791 | A | 11/1983 | Haq | 510/296 |
| 5,300,236 | A * | 4/1994 | Bortolotti et al. | 510/334 |
| 6,296,914 | B1 | 10/2001 | Kerins et al. | 428/41.8 |
| 6,579,843 | B2 * | 6/2003 | Cropper et al. | 510/439 |

FOREIGN PATENT DOCUMENTS

| | | |
|---|---|---|
| EP | 0 338 350 A2 | 10/1989 |
| EP | 0 479 404 A2 | 4/1992 |
| JP | 01029438 A * | 1/1989 |

OTHER PUBLICATIONS

Patent Abstracts of Japan, vol. 013, No. 211, May 17, 1989, JP 01 029438 A, published Jan. 31, 1989, Kao Corp.

* cited by examiner

*Primary Examiner*—Lorna M. Douyon
(74) *Attorney, Agent, or Firm*—Jason J. Camp; Armina E. Matthews; Kim William Zerby

(57) ABSTRACT

Water-soluble pouches comprise water-soluble films coated by a zeolite powder having a specific oil absorption of 0.4 ml/m$^2$ or more. Processes for producing such pouches use a zeolite powder having a specific oil absorption of 0.4 ml/m$^2$ or more for coating the water-soluble pouch.

7 Claims, No Drawings

WATER-SOLUBLE POUCHES

CROSS REFERENCE TO RELATED APPLICATIONS

This application claims priority under 35 U.S.C. §119(a) to European Application Serial No. 01870257.0, filed Nov. 23, 2001.

TECHNICAL FIELD

The present invention relates to water-soluble pouches and processes for their production.

BACKGROUND TO THE INVENTION

Pouch compositions are known in the art. These compositions have the advantage that they are easy to dose, handle, transport and store. Recently, water-soluble pouches containing cleaning or fabric care compositions have become popular. Usually the pouches are formed by placing two sheets of film together, sealing three edges, filling with the appropriate product, which is typically a gel or liquid, and then sealing the forth edge.

The film material used in water-soluble pouches is necessarily relatively fragile since it must release the product quickly, completely and without leaving residue. To achieve this, the film material must be thin and must have a high water-reactivity. This can lead to problems with the product being released prematurely due to the stresses of production, packing and transportation or due to exposure to a moist environment. In particular, it is difficult to stop the pouches from leaking small amounts of product, a process which is known as 'weeping'. A weeping pouch exhibits small quantities of the pouch contents on the film surface. Weeping causes the pouches to feel unpleasant to the touch. In addition, weeping pouches can contaminate the surface of other materials through physical contact.

The incorporation of powder into film material is known in the art. See, for example, JP-A-64/29438 (Kao) which describes a polyvinyl alcohol type film obtained by distributing an aqueous dispersion containing 5–30% by weight of a fine powder with a mean particle size of from 0.5–100 microns on one or both sides and then drying the film. The resultant film is said to have good slip properties and adhesion resistance. In addition, powdering of film material is known. See, for example, EP-A-338350 (Asahi) which describes a dusting treatment agent for imparting inter-film lubricity to a film of thermoplastic resin.

The applicant has surprisingly found that weeping can be reduced or eliminated by coating water-soluble films with powder having a specific oil absorption of 0.4 ml/m$^2$ or more.

SUMMARY OF THE INVENTION

The present invention relates to water-soluble pouches and, in particular, to water-soluble pouches comprising water-soluble film coated by a powder having a specific oil absorption of 0.4 ml/m$^2$ or more. In addition, the present invention relates to processes for producing such pouches and to the use of a powder having a specific oil absorption of 0.4 ml/m$^2$ or more for coating water-soluble pouch material.

DETAILED DESCRIPTION OF THE INVENTION

The present invention relates to water-soluble pouches made from water-soluble films coated by a powder having a specific oil absorption of 0.4 ml/m$^2$ or more. The pouch can be of any form, shape and material which is suitable to hold the composition, e.g. without allowing the release of the composition from the pouch prior to contact of the pouch to water. The exact execution will depend on, for example, the type and amount of the composition in the pouch, the number of compartments in the pouch, the characteristics required from the pouch to hold, protect and deliver or release the compositions. The pouch may be of such a size that it conveniently contains either a unit dose amount of the composition herein, suitable for the required operation, for example one wash, or only a partial dose, to allow the consumer greater flexibility to vary the amount used, for example depending on the size and/or degree of soiling of the wash load.

The pouches herein can comprise a single compartment or multiple compartments. If the pouch has multiple compartments, the different compartments can comprise the same composition or, more preferably, can comprise different compositions. The present pouches typically contain less than 200 ml, preferably less than 100 ml, of a cleaning or fabric care composition. The pouches herein are preferably for use in an automatic dish-washer or in an automatic fabric-washing machine.

Powder

The pouch material used herein must be at least partially coated with a powder having a specific oil absorption of 0.4 ml/m$^2$ or more The powder preferably has a specific oil absorption of 0.5 ml/m$^2$ or more, more preferably of 0.75 ml/m$^2$ or more, even more preferably of 1.0 ml/m$^2$ or more.

The coating can be applied to both sides of the film but is preferably only on the outside.

The powder used herein must have a specific oil absorption of 0.4 ml/m$^2$ or more when it is applied to the pouch surface in a monolayer. The inventors have found that the capability of a powder to ameliorate weeping in water-soluble pouches depends on a number of factors, including the average particle size (D), the absolute particle density ($\rho_{abs}$), the oil absorption capacity (Q) and the total intrusion volume (TIV) of the powder. Assuming that the individual powder particles can be represented by ideal spheres with a diameter equal to the average particle size (D), and assuming furthermore that these ideal spheres are covering the pouch surface (film) in a monolayer, the specific oil absorption can be determined by the following formula:

$$Q_{sp} = \frac{N \times m \times Q}{A}$$

where N is the number of particles which make up for a monolayer of particles on the film, m is the mass of a singe particle, Q is the amount of oil which can be absorbed by the powder and A is the surface of the film.

The number of particles which is required to form a monolayer on the film is determined by the average diameter of the particles and can be calculated to:

$$N = \frac{A}{D^2 \sin(60°)}$$

The mass of a singe particle (m) is a function of the absolute density ($\rho_{abs}$), the particle volume (V) and the total intrusion volume (TIV) of the powder, and can be calculated to:

$$m = \frac{\rho_{abs}}{1 + TIV \times \rho_{abs}} \times V$$

where the particle volume (V) can be calculated form the average particle diameter (D):

$$V = \frac{4\pi}{3} \times \left(\frac{D}{2}\right)^3$$

The particle size (D), can be determined with a Laser Diffraction based Particle Size Analyzer "Mastersizer® Type S Long Bed 2.18" of Malvern Instruments, Malvern, England. This commercially available device uses laser diffraction technology to determine particle sizes and particle size distributions of fine powders. A small powder sample is fluidized with dry compressed air and conveyed through a screen into a detection cell where it is exposed to a laser light beam. The pattern of laser light scattering is characteristic for a particle size distribution. The Malvern software analyzes this pattern based on spherical particles and presents the result in the form of a Particle Diameter Histogram. The software also calculates the parameter D(v, 50) which is the particle size at which 50% of the sample is smaller and 50% is larger than this size. This parameter is also known as the mass median diameter (MMD).

The absolute density ($\rho_{abs}$) can be measured by Helium Pyconometry. Pyconometers measure density by calculating the difference in weight between the full and empty pycnometer and its known volume. For the purposes of the present invention the measurements can be made on an Accupyc 1330 Pycnometer (available from Microneritics, Norcross, Ga., USA). The measurements are performed in the following manner:

1. The Accupyc 1330 is switched on and a Helium gas cylinder is turned on to give 20 psi pressure. The Accupyc is then allowed to warm up for 30 minutes
2. The sample cup is removed and placed on a balance. The balance is then reset to zero.
3. The sample cup is filled ⅔ full with the test material & the weight recorded.
4. The sample cup is then replaced in the cell chamber and the sample analysed.
5. The result is the density of the material tested (excluding voidage and pore space) in g/cm$^3$.

The total intrusion volume (TIV) is the void volume in one unit mass of powder. It can be measured by mercury porosimetry using a Carlo Erba mercury porosimeter. This technique permits to measure the pore volume and size by forcing mercury to penetrate inside the open porosity. Mercury is used because it behaves as a non-wetting liquid with a large number of materials. Mercury is forced to enter into the pores by applying a controlled increasing pressure. As the sample holder is filled with mercury under vacuum conditions (mercury surrounds the sample without entering the pores due to the very low residual pressure), during the experiment the pressure is increased and the volume of mercury penetrated is detected by means of a capacitive system. The decreasing volume of mercury in the sample holder represents the pore volume.

The oil absorption (Q) can be determined using ASTM D281-84/D234-82 ("Standard Test Method for Oil Absorption of Pigments by Spatula Rub-Out") using Linseed Oil as specified in ASTM D234-82 Standard Specification for Raw Linseed Oil. This method is widely used to characterize pigments, fillers, paints and coatings. Linseed Oil can be purchased from The Sigma-Aldrich Corporation (http://www.sigma-aldrich.com/) under Product Number 430021.

Preferred powders herein typically have an average particle size is between 0.5 $\mu$m and 50 $\mu$m, an absolute particle density of between 500 g/l and 5,000 g/l and the absorption capacity between 10 g and 500 g liquid or gel per 10 g powder. Mixtures of powders can be used.

It is preferred that the powder comprise less than 10% by weight of particles having a size of more than 100 $\mu$m. Particle size is determined with a Mastersizer® of Malvern Instruments, Malvern, England.

Preferred powders for use herein include native or modified starch (such as corn starch, potato starch or hydroxy ethyl starch), amylose, cyclodextrins, silicas (including silica gels), alumina, zinc oxide, zeolites (especially overdried zeolites), activated carbon, carbon molecular sieves, bentonite clays, and mixtures thereof. More preferred are amylose, silicas, zeolites, and mixtures thereof. Especially preferred are zeolites, and mixtures thereof.

In a preferred embodiment the powder herein comprises perfume. One issue associated with pouches is that the fragrance which is part of the cleaning or fabric care compositions does not penetrate the film and so the product does not have a distinctive odor or has the odor of the film material itself which is often not consumer acceptable. This issue can be overcome by using powder comprising perfume. This is of particular use when the powder has a 'pore' or 'cage' structure such as cylcodextrins or zeolites. The perfume is then trapped in the pore/cage and its release is consequently slowed so extending the period during which the odor of the film material is masked and the pouch retains its distinctive odor. In addition, powders comprising perfumes allow the formulator more flexibility in terms of scent, enabling him to have one scent before use and a different scent remaining on the washed items after use.

Zeolites and cyclodextrines can be loaded with perfumes to create Perfume Loaded Zeolites (PLZ) or Perfume Loaded Cyclodextrines (PLC). Small quantities can be prepared in a beaker of approx. 100 ml. A small quantity of powder is filled into this beaker, and the perfume is sprayed onto the powder. This process is exothermic and care has to be taken to control the rise in temperature which may reach 70° C. and more. Larger quantities of Perfume Loaded powders can be prepared by dosing powder and perfume into a mixer (continuous or batch), such as the Lödige KM or the Schugi mixer. Typically, this process results in a higher yield as less perfume is lost due to evaporation. The degree of loading and the retention level are based on the physicochemical properties, such as the molecular structure of the powder and the perfume, and the process conditions during loading, such as the mixing time and the mixing temperature. If necessary, additives, carriers or blockers can be used to increase the yield of the loading process and the retention level. Typical retention levels range from 10% to 70%. A more detailed description of a process for producing PLZ can be found in U.S. Pat. No. 5,648,328 (Procter & Gamble). A more detailed description of PLC can be found in U.S. Pat. No. 5,232,612 (Procter & Gamble).

Powdering Process

The powder can be applied to the pouch material by any suitable means. One such means is the dissolution or suspension of the powder in a non-aqueous solvent which is then atomized and sprayed onto the pouch. However, this process creates a significant amount of solvents which may be hazardous in nature and need to be recuperated and condensed.

In an alternative process the powder is applied to the pouch material by rotating brushes which are in contact with the powder. Another process uses gravity to make pouches slide over a dusted surface. The transfer of powder and the movement of the pouches may be enhanced by vibrating this surface. These processes have the advantage that they do not rely on solvents. However, it is difficult to control the quantity of powder applied to the pouches when using this process.

In another process, the powder is fluidized in air, using a fluidization chamber such as a fluidized bed produced by Niro A/S, Soeborg, Denmark. The fluidized powder is then brought into contact with the pouch material. This can be done by pneumatically conveying the fluidized powder and directing said powder stream at one or more pouches. Pneumatic conveying systems are available from Clyde Pneumatic Conveying Ltd., Doncaster, England. This process can be both continuous, ie. based on a continuous movement of pouches, or intermittent, ie. based on individual pouches.

In a preferred process of the powder coating process, one or more stationary powder spray guns are used to direct the powder stream towards the pouches which are transported through the coating zone by means of a belt conveyor. While some powder will remain on the pouches, it is not unusual that 50% or even more than 75% of the fluidized powder does not contact the pouches, either because it is not brought into contact with the pouch or because it does not adhere to the pouch with sufficient force. This 'oversprayed' powder is recuperated, separated from the fluidization air by means of filters and/or cyclones and recycled into the powder reservoir.

In a particularly preferred process, electrostatic forces are employed to enhance the attraction between the powder and the pouch. This process is typically based on negatively charging the powder particles and directing these charged particles to the grounded pouches. However, other arrangements are possible and may be preferred depending on the powder. It was observed that the contact time between the powder and the pouch can be significantly reduced, thus reducing the level of overspraying and recycling and the processing time required for powder coating. A preferred powder for use with the electrostatic coating process is zeolite. It was found that zeolite can be effectively charged when an electrode is built into the powder spray gun. This electrode may be charged with up to 100 kV (DC). The resulting powder distribution is very uniform. It is especially advantageous that the charged powder also tends to adhere to the side of the pouch which is opposite to the spray gun. Also, it was found that the adhesion between charged zeolite and a pouch is stronger than the adhesion between normal (uncharged) zeolite and a pouch. This reduces the processing time and reduces powder losses in following processing steps. Electrostatic powder coating systems are available from Nordson Corporation, Westlake, Ohio, USA The present invention includes the use of powders having a specific oil absorption of 0.4 ml/m$^2$ or more for coating water-soluble pouches and for the retardation of weeping of water-soluble pouches. Preferred powders for the present use include amylose, silicas, zeolites, and mixtures thereof.

Film Material

It is preferred that the film used herein comprises material which is water-soluble. Preferred water-soluble films are polymeric materials, preferably polymers which are formed into a film or sheet. The material in the form of a film can for example be obtained by casting, blow-molding, extrusion or blow extrusion of the polymer material, as known in the art. Preferred water-dispersible material herein has a dispersability of at least 50%, preferably at least 75% or even at least 95%, as measured by the method set out hereinafter using a glass-filter with a maximum pore size of 50 microns. More preferably the material is water-soluble and has a solubility of at least 50%, preferably at least 75% or even at least 95%, as measured by the method set out hereinafter using a glass-filter with a maximum pore size of 50 microns, namely:

Gravimetric Method for Determining Water-solubility or Water-dispersability of the Material of the Compartment and/or Pouch:

5 grams±0.1 gram of material is added in a 400 ml beaker, whereof the weight has been determined, and 245 ml±1 ml of distilled water is added. This is stirred vigorously on magnetic stirrer set at 600 rpm, for 30 minutes. Then, the mixture is filtered through a folded qualitative sintered-glass filter with the pore sizes as defined above (max. 50 micron). The water is dried off from the collected filtrate by any conventional method, and the weight of the remaining polymer is determined (which is the dissolved or dispersed fraction). Then, the percentage solubility or dispersability can be calculated.

The polymer can have any weight average molecular weight, preferably from about 1000 to 1,000,000, or even form 10,000 to 300,000 or even form 15,000 to 200,000 or even form 20,000 to 150,000.

Preferred film materials are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferably the polymer is selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, polyvinyl alcohols, polyvinyl alcohol copolymers and hydroxypropyl methyl cellulose (HPMC), and mixtures thereof. Most preferred are polyvinyl alcohols. Preferably, the level of a type polymer (e.g., commercial mixture) in the film material, for example PVA polymer, is at least 60% by weight of the film.

Mixtures of polymers can also be used. This may in particular be beneficial to control the mechanical and/or dissolution properties of the compartment or pouch, depending on the application thereof and the required needs. For example, it may be preferred that a mixture of polymers is present in the material of the compartment, whereby one polymer material has a higher water-solubility than another polymer material, and/or one polymer material has a higher mechanical strength than another polymer material. It may be preferred that a mixture of polymers is used, having different weight average molecular weights, for example a mixture of PVA or a copolymer thereof of a weight average molecular weight of 10,000–40,000, preferably around 20,000, and of PVA or copolymer thereof, with a weight average molecular weight of about 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1–35% by weight polylactide and approximately from 65% to 99% by weight polyvinyl alcohol, if the material is to be water-dispersible, or water-soluble. It may be preferred that the PVA present in the film is from 60–98% hydrolysed, preferably 80% to 90%, to improve the dissolution of the material.

Most preferred are films, which are water-soluble and stretchable films, as described above. Highly preferred water-soluble films are films which comprise PVA polymers and that have similar properties to the film known under the trade reference M8630, as sold by Chris-Craft Industrial Products of Gary, Ind., US and also PT-75, as sold by Aicello of Japan.

The water-soluble film herein may comprise other additive ingredients than the polymer or polymer material. For example, it may be beneficial to add plasticisers, for example glycerol, ethylene glycol, diethyleneglycol, propylene glycol, sorbitol and mixtures thereof, additional water, disintegrating aids. It may be useful that the pouch or water-soluble film itself comprises a detergent additive to be delivered to the wash water, for example organic polymeric soil release agents, dispersants, dye transfer inhibitors.

It is preferred that the water-soluble film is stretched during formation and/or closing of the pouch, such that the resulting pouch is at least partially stretched. This is to reduce the amount of film required to enclose the volume space of the pouch. When the film is stretched the film thickness decreases. The degree of stretching indicates the amount of stretching of the film by the reduction in the thickness of the film. For example, if by stretching the film, the thickness of the film is exactly halved then the stretch degree of the stretched film is 100%. Also, if the film is stretched so that the film thickness of the stretched film is exactly a quarter of the thickness of the unstretched film then the stretch degree is exactly 200%. Typically and preferably, the thickness and hence the degree of stretching is non-uniform over the pouch, due to the formation and closing process. For example, when a water-soluble film is positioned in a mold and an open compartment is formed by vacuum forming (and then filled with the components of a composition and then closed), the part of the film in the bottom of the mold, furthest removed from the points of closing will be stretched more than in the top part. Preferably, the film which is furthest away from the opening, e.g. the film in the bottom of the mold, will be stretched more and be thinner than the film closest by the opening, e.g. at the top part of the mold.

Another advantage of using stretching the pouch is that the stretching action, when forming the shape of the pouch and/or when closing the pouch, stretches the pouch non-uniformly, which results in a pouch which has a non-uniform thickness. This allows control of the dissolution of water-soluble pouches herein, and for example sequential release of the components of the detergent composition enclosed by the pouch to the water.

Preferably, the pouch is stretched such that the thickness variation in the pouch formed of the stretched water-soluble film is from 10 to 1000%, preferably 20% to 600%, or even 40% to 500% or even 60% to 400%. This can be measured by any method, for example by use of an appropriate micrometer. Preferably the pouch is made from a water-soluble film that is stretched, said film has a stretch degree of from 40% to 500%, preferably from 40% to 200%.

Composition

Unless stated otherwise all percentages herein are calculated based on the total weight of the all the composition but excluding the film.

The pouches of the present invention can comprise a variety of compositions. Preferred are cleaning compositions, fabric care compositions, or hard surface cleaners. More preferably the compositions is a laundry, fabric care or dish washing composition including, pre-treatment or soaking compositions and other rinse additive compositions. The composition can be in any suitable form such as a liquid, a gel, a solid, or a particulate (compressed or uncompressed). Preferably the composition is a liquid or a gel.

If the composition is a liquid or gel, the total amount of water is preferably less than 25%, more preferably less than 10%, even more preferably from 1% to 8%, by weight of composition. This is on the basis of free water added to the composition.

The composition can made by any method and can have any viscosity, typically depending on its ingredients. The liquid/gel compositions preferably have a viscosity of 50 to 10000 cps (centipoises), as measured at a rate of 20 $s^{-1}$, more preferably from 300 to 3000 cps or even from 400 to 600 cps. The compositions herein can be Newtonian or non-Newtonian. The liquid composition preferably has a density of 0.8 kg/l to 1.3 kg/l, preferably around 1.0 to 1.1 kg/l.

In the compositions herein it is preferred that at least a surfactant and builder are present, preferably at least anionic surfactant and preferably also nonionic surfactant, and preferably at least water-soluble builder, preferably at least phosphate builder or more preferably at least fatty acid builder. Preferred is also the presence of enzymes and preferred may also be to incorporate a bleaching agent, such as a preformed peroxyacid. Highly preferred are also perfume, brightener, buffering agents, fabric softening agents, including clays and silicones benefit agents, suds suppressors, colorant or dye and/ or pearlescence agent.

In hard-surface cleaning compositions and dish wash compositions, it is preferred that at least a water-soluble builder is present, such as a phosphate, and preferably also surfactant, perfume, enzymes, bleach.

In fabric enhancing compositions, preferably at least a perfume and a fabric benefit agent are present for example a cationic softening agent, or clay softening agent, anti-wrinkling agent, fabric substantive dye.

Highly preferred in all above compositions are also additional solvents, such as alcohols, diols, monoamine derivatives, glycerol, glycols, polyalkylane glycols, such as polyethylene glycol. Highly preferred are mixtures of solvents, such as mixtures of alcohols, mixtures of diols and alcohols, mixtures. Highly preferred may be that (at least) an alcohol, diol, monoamine derivative and preferably even glycerol are present. The compositions of the invention are preferably concentrated liquids having preferably less than 50% or even less than 40% by weight of solvent, preferably less than 30% or even less than 20% or even less than 35% by weight. Preferably the solvent is present at a level of at least 5% or even at least 10% or even at least 15% by weight of the composition.

Preferably the compositions herein comprise surfactant. Any suitable surfactant may be used. Preferred surfactants are selected from anionic, amphoteric, zwitterionic, non-ionic (including semi-polar nonionic surfactants), cationic surfactants and mixtures thereof. The compositions preferably have a total surfactant level of from 0.5% to 75% by weight, more preferably from 1% to 60% by weight, most preferably from 40% to 55% by weight of total composition. Detergent surfactants are well known and described in the art (see, for example, "Surface Active Agents and Detergents", Vol. I & II by Schwartz, Perry and Beach). Especially preferred are compositions comprising anionic surfactants. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate surfactants are preferred. Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

The composition can comprise a cyclic hydrotrope. Any suitable cyclic hydrotrope may be used. However, preferred hydrotropes are selected from salts of cumene sulphonate, xylene sulphonate, naphthalene sulphonate, p-toluene sulphonate, and mixtures thereof. Especially preferred are salts of cumene sulphonate. While the sodium form of the hydrotrope is preferred, the potassium, ammonium, alkanolammonium, and/or $C_2$–$C_4$ alkyl substituted ammonium forms can also be used.

The compositions herein may contain a $C_5$–$C_{20}$ polyol, preferably wherein at least two polar groups that are separated from each other by at least 5, preferably 6, carbon atoms. Particularly preferred $C_5$–$C_{20}$ polyols include 1,4 Cyclo Hexane Di Methanol, 1,6 Hexanediol, 1,7 Heptanediol, and mixtures thereof.

The compositions preferably comprise a water-soluble builder compound, typically present in detergent compositions at a level of from 1% to 60% by weight, preferably from 3% to 40% by weight, most preferably from 5% to 25% by weight of the composition.

Suitable water-soluble builder compounds include the water soluble monomeric carboxylates, or their acid forms, or homo or copolymeric polycarboxylic acids or their salts in which the polycarboxylic acid comprises at least two carboxylic radicals separated from each other by not more that two carbon atoms, and mixtures of any of the foregoing. Preferred builder compounds include citrate, tartrate, succinates, oxydissuccinates, carboxymethyloxysuccinate, nitrilotriacetate, and mixtures thereof.

Highly preferred may be that one or more fatty acids and/or optionally salts thereof (and then preferably sodium salts) are present in the detergent composition. It has been found that this can provide further improved softening and cleaning of the fabrics. Preferably, the compositions contain 1% to 25% by weight of a fatty acid or salt thereof, more preferably 6% to 18% or even 10% to 16% by weight. Preferred are in particular $C_{12}$–$C_{18}$ saturated and/or unsaturated, linear and/or branched, fatty acids, but preferably mixtures of such fatty acids. Highly preferred have been found mixtures of saturated and unsaturated fatty acids, for example preferred is a mixture of rape seed-derived fatty acid and $C_{16}$–$C_{18}$ topped whole cut fatty acids, or a mixture of rape seed-derived fatty acid and a tallow alcohol derived fatty acid, palmitic, oleic, fatty alkylsuccinic acids, and mixtures thereof.

The compositions herein may comprise phosphate-containing builder material. Preferably present at a level of from 2% to 60%, more preferably from 5% to 50%. Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

The compositions herein may contain a partially soluble or insoluble builder compound, typically present in detergent compositions at a level of from 0.5% to 60% by weight, preferably from 5% to 50% by weight, most preferably from 8% to 40% weight of the composition. Preferred are aluminosilicates and/or crystalline layered silicates such as SKS-6, available from Clariant.

It is preferred that the compositions herein comprise perfume. Highly preferred are perfume components, preferably at least one component comprising a coating agent and/or carrier material, preferably organic polymer carrying the perfume or alumniosilicate carrying the perfume, or an encapsulate enclosing the perfume, for example starch or other cellulosic material encapsulate. Preferably the compositions of the present invention comprise from 0.01% to 10% of perfume, more preferably from 0.1% to 3%. The different compartments herein can comprise different types and levels of perfume.

The compositions herein can comprise fabric softening clays. Preferred fabric softening clays are smectite clays, which can also be used to prepare the organophilic clays described hereinafter, for example as disclosed in EP-A-299575 and EP-A-313146. Specific examples of suitable smectite clays are selected from the classes of the bentonites—also known as montmorillonites, hectorites, volchonskoites, nontronites, saponites and sauconites, particularly those having an alkali or alkaline earth metal ion within the crystal lattice structure. Preferably, hectorites or montmorillonites or mixtures thereof. Hectorites are most preferred clays. Examples of hectorite clays suitable for the present compositions include Bentone EW as sold by Elementis.

Another preferred clay is an organophilic clay, preferably a smectite clay, whereby at least 30% or even at least 40% or preferably at least 50% or even at least 60% of the exchangeable cations is replaced by a, preferably long-chain, organic cations. Such clays are also referred to as hydrophobic clays. The cation exchange capacity of clays and the percentage of exchange of the cations with the long-chain organic cations can be measured in several ways known in the art, as for example fully set out in Grimshaw, The Chemistry and Physics of Clays, Interscience Publishers, Inc.,pp. 264–265 (1971). Highly preferred are organophilic clays as available from Rheox/Elementis, such as Bentone SD-1 and Bentone SD-3, which are registered trademarks of Rheox/Elementis.

The compositions herein preferably comprise a bleaching system, especially a perhydrate bleach system. Examples of prehydrate bleaches include salts of percarbonates, particularly the sodium salts, and/or organic peroxyacid bleach precursor, and/or transition metal bleach catalysts, especially those comprising Mn or Fe. It has been found that when the pouch or compartment is formed from a material with free hydroxy groups, such as PVA, the preferred bleaching agent comprises a percarbonate salt and is preferably free form any perborate salts or borate salts. It has been found that borates and perborates interact with these hydroxy-containing materials and reduce the dissolution of the materials and also result in reduced performance. Inorganic perhydrate salts are a preferred source of peroxide. Examples of inorganic perhydrate salts include percarbonate, perphosphate, persulfate and persilicate salts. The inorganic perhydrate salts are normally the alkali metal salts. Alkali metal percarbonates, particularly sodium percarbonate are preferred perhydrates herein.

The compositions herein preferably comprises a peroxy acid or a precursor therefor (bleach activator), preferably comprising an organic peroxyacid bleach precursor. It may be preferred that the composition comprises at least two peroxy acid bleach precursors, preferably at least one hydrophobic peroxyacid bleach precursor and at least one hydrophilic peroxy acid bleach precursor, as defined herein. The production of the organic peroxyacid occurs then by an in-situ reaction of the precursor with a source of hydrogen peroxide. The hydrophobic peroxy acid bleach precursor preferably comprises a compound having a oxy-benzene sulphonate group, preferably NOBS, DOBS, LOBS and/or NACA-OBS, as described herein. The hydrophilic peroxy acid bleach precursor preferably comprises TAED.

Amide substituted alkyl peroxyacid precursor compounds can be used herein. Suitable amide substituted bleach activator compounds are described in EP-A-0170386.

The compositions may contain a pre-formed organic peroxyacid. A preferred class of organic peroxyacid compounds are described in EP-A-170,386. Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

The compositions may also contain a bittering agent such as Bitrex to prevent intake by humans, colored powders to improve aesthetics, brighteners, and/or cyclodextrins.

Another preferred ingredient useful in the compositions herein is one or more enzymes. Suitable enzymes include enzymes selected from peroxidases, proteases, glucoamylases, amylases, xylanases, cellulases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, dextranase, transferase, laccase, mannanase, xyloglucanases, or mixtures thereof. Detergent compositions generally comprise a cocktail of conventional applicable enzymes like protease, amylase, cellulase, lipase.

The compositions herein are preferably not formulated to have an unduly high pH. Preferably, the compositions of the present invention have a pH, measured as a 1% solution in distilled water, of from 7.0 to 12.5, more preferably from 7.5 to 11.8, most preferably from 8.0 to 11.5.

Process

The pouches herein can be produced by any suitable method. For example, the pouches can be formed by use of a die having series of molds and forming from a film that has been pre-powdered on the outside, open pouches in these molds to which product can be added and then the pouch is sealed. Another, process that can be used herein is the formation of pouches in molds present on the surface of a circular drum. Hereby, a film is circulated over the drum and pockets are formed, which pass under a filling machine to add product the open pockets. The pouch is then sealed. A preferred process for use herein is a horizontal, continuous process whereby a horizontally positioned portion of an endless surface with molds (in two dimensions), which moves continuously in one direction, is used to form the pouches, namely whereby a film is continuously fed onto this surface, and then, the film is drawn into the molds on the horizontal portion of the surface, to continuously form a web of open pouches positioned in horizontal position, to which product is added, whilst horizontal and whilst moving continuously. The pouch is then sealed, preferably whilst still horizontal and moving continuously.

The films may be drawn into the molds by any suitable method but are preferably drawn in by a vacuum which can be applied through vacuum ports in the mold.

The sealing can be achieved by conventional means such as heat-sealing but, preferably, is achieved by solvent-welding. As used herein the term "solvent-welding" refers to the process of forming at least a partial seal between two or more layers of film material by use of a solvent such as water. This does not exclude that heat and pressure may also be applied to form a seal.

Any suitable solvent may be used herein. It is preferred that the solvent has a viscosity in the range 0.5 to 15,000 mPa.s, preferably from 2 to 13,000 mPa.s (measured by DIN 53015 at 20° C.). Preferred solvents for use herein comprise plasticiser, for example 1,2 propanediol, and water. A preferred sealing process involves applying solvent comprising plasticiser to the film and then applying heat and/or pressure. The temperature is preferably from 30° C. to 250° C., more preferably from 50° C. to 200° C. The pressure is preferably from 10 $Nm^{-2}$ to $1.5\times10^{7}$ $Nm^{-2}$, more preferably from 100 $Nm^{-2}$ to $1\times10^{5}$ $Nm^{-2}$.

EXAMPLES

Example I

A section of water-soluble, PVA based film with a thickness of 76 micrometer (PT-75 available form Aicello of Japan) was placed over the mold of a horizontal thermoforming machine. The molds were of a square shape with approximate dimension of 55 mm×55 mm. The film was drawn into the molds by a vacuum applied through vacuum ports in the mold. The film was carefully heated to facilitate its deformation. 52 ml of an essentially water-free, liquid cleaning composition are then added to the thermoformed film cavity. A second layer of film was then coated with a thin layer of a water-based solvent and placed above the filled cavities where it was sealed to the first layer of film.

800 pouches were prepared by this method. 400 of those pouches were subsequently treated as follows:

Overdried sodium aluminosilicate (zeolite A) was obtained from Industrial Chemicals Ltd. of London. The Specific Oil Absorption was calculated as 0.6 $ml/m^2$ (D=3.24 $\mu$m, $\rho_{abs}$=2154 g/l, TIV=1.53 ml/g, and Q=61 ml/100 g). The water content was determined to be 6.1%. 30 The zeolite powder was fluidized in a fluidization hopper (from Nordson Inc., part no. 139364) using dry compressed air. The hopper was placed on a vibrating table to enhance particle fluidization. A pneumatically activated powder pump (Nordson Inc. P/N 165637) was used to convey the powder from the hopper to a powder spray gun (Nordson Inc. type Versa Spray II IPS, P/N 107016E). The powder transfer rate was controlled from the control unit (Nordson Inc. P/N 106991C). A pressure setting of 0.9 bar was used for the atomization air, a setting of 2.5 bar was used for the fluidization air. This resulted in a powder transfer rate of around 0.2 kg/hr. The charge of the electrode inside the powder spray gun was set to approximately 65 kV. The powder spray gun was then placed inside a ventilated booth (Nordson Inc. type Micromax) to ensure that no powder dust escaped. A mesh belt (Wirebelt Ltd, UK) traversed the booth. The powder gun was placed below the mesh belt, such that the powder is sprayed upwards. At the tip of the spray gun, a flat spray nozzle was fitted such that the plane of the powder spray is perpendicular to the direction of the belt. Pouches were placed onto the belt at the feeding side such that the thermoformed side was in contact with the belt. They were then spray coated and collected at the discharge side of the belt. The amount of powder which was applied by this method was about 1 mg/pouch.

The pouches were then stored in packs of 20 for 7 days and subsequently assessed for weeping. Of the untreated pouches 280 exhibited weeping. Of the powdered pouches only 6 pouches showed any sign of weeping after 7 days and only 3 showed signs of weeping after 28 days.

Example II

Water soluble pouches containing an essentially water-free liquid cleaning composition were prepared as described in example 1, but using Monosol M6830, a water soluble, PVA-based film from Chris Craft Industrial Products of Gary, Ind., USA.

500 pouches were prepared by the above method. 250 were then treated as follows:

Regular zeolite A with a water content of 14% was obtained from Industrial Chemicals Ltd. of London. The Specific Oil Absorption was been calculated as 0.43 ml/m$^2$ (D=3.24 $\mu$m, $\rho_{abs}$=1902 g/l, TIV=1.4 ml/g, and Q=42 ml/100 g). The zeolite was filled into the hopper of a screw feeder (K-Tron). The speed of the screw can be set to a discharge rate of 0.5 kg/hr. At the outlet of the screw, a powder pump (Nordson Inc. P/N 165637) was installed to convey the powder from the screw to the powder spray gun (Nordson Inc. type Versa Spray II IPS, P/N 107016E). A pressure setting of 2.0 bar was used for the atomization air, a setting of 4.0 bar was used for the fluidization air. The charge of the electrode inside the powder spray gun was set to approximately 30kV. The powder spray gun was placed inside a ventilated booth (Nordson Inc. type Micromax) to ensure that no powder dust escaped. A mesh belt (Wirebelt Ltd, UK) traversed the booth. The powder gun is placed below the mesh belt, such that the powder is sprayed upwards. At the tip of the spray gun, a flat spray nozzle is fitted such that the plane of the powder spray is perpendicular to the direction of the belt. Pouches were placed onto the belt at the feeding side such that the thermoformed side was in contact with the belt. They are then spray coated and collected at the discharge side of the belt. The amount of powder which is applied by this method ranged from 0.5 to 1.5 mg/pouch.

The pouches were then stored in packs of 20 pouches for 7 days and subsequently assessed for weeping. It was found that, of the untreated pouches 125 showed some signs of weeping. Of the treated pouches only 19 exhibited weeping.

Example III

Water soluble pouches containing an essentially water-free liquid cleaning composition were prepared as described in example 2. Perfume loaded Zeolite (PLZ) was prepared using overdried sodium aminosilicate (zeolite A) obtained from Industrial Chemicals Ltd. of London according to the method disclosed in U.S. Pat. No. 5,648,328 and further detailed above. The same level of weeping reduction was obtained as in example II.

Example IV

Powdered Amylose was obtained from Nikka of Japan (Nikkalyco AS-100S). The Specific Oil Absorption was calculated as 2.44 ml/m$^2$ (D=14.3 $\mu$m, $\rho_{abs}$=1485 g/l, TIV=0.14 ml/g, Q=23 ml/100 g. 200 water soluble pouches were prepared as described in Example I using PT-75 film. Another 200 water soluble pouches were made as described in Example II using Monosol 8630 film. 100 pouches of each film type were placed in a hair net which was then inserted into the fluidization chamber of a fluidized bed. Amylose powder was placed in the fluidized bed where it was fluidized and moved from the bottom of the chamber to the top. The pouches were exposed to the fluidized Amylose for about 15 seconds. Any excess powder was shaken off.

Of the Monosol pouches, 73% of the unpowdered pouches showed weeping but none of the powdered pouches demonstrated any weeping.

Of the PT-75 pouches, 43% of the unpowdered pouches showed weeping but only 3% of the powdered pouches showed weeping.

Comparative Example

Talcum was obtained from The Sigma-Aldrich Corporation (http://www.sigma-aldrich.com/) and analyzed for material properties: average particle size (D) was determined to be 3.82 micrometer, the absolute density (rabs) was 2928 g/l, a total intrusion volume (TIV) was 1.62 ml/g and the oil absorption capacity (Q) was 28 ml linseed oil/100 g. The Specific Oil Absorption was calculated to 0.33 ml/m2. 200 water soluble pouches were prepared as described in example I using PT-75 film. These were coated with Talcum powder as described in Example VI. After powdering, 38% of these pouches were found to show signs of weeping.

What is claimed is:

1. A water-soluble pouch containing a cleaning or fabric care liquid or gel composition characterized in that the pouch comprises water-soluble film coated by a zeolite powder having a specific oil absorption of 0.4 ml/m$^2$ or more.

2. A water-soluble pouch according to claim 1 wherein less than 10% by weight of particles of the zeolite powder have a size of more than 100 $\mu$m.

3. A water-soluble pouch according to claim 1 wherein the powder is electrostatically chargeable.

4. A water-soluble pouch according to claim 1 wherein the liquid or gel composition comprises a laundry, fabric care or dish washing composition.

5. A water-soluble pouch according to claim 1 wherein the powder comprises a perfume.

6. A water-soluble pouch according to claim 1 wherein the film is selected from the group consisting of polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, polyvinyl alcohols, polyvinyl alcohol copolymers, and mixtures thereof.

7. A process for producing a water-soluble pouch according to claim 1 which comprises a step of coating said water-soluble film with a zeolite powder having a specific oil absorption of 0.4 ml/m$^2$ or more.

* * * * *